United States Patent [19]

Hadar

[11] 4,282,421

[45] Aug. 4, 1981

[54] DUAL COMPARTMENT ELECTRIC WATER HEATER

[76] Inventor: Arieh Hadar, 2 Hamaavak St., Givatayim, Israel

[21] Appl. No.: 16,958

[22] Filed: Mar. 5, 1979

[30] Foreign Application Priority Data

Apr. 2, 1978 [IL] Israel ..... 54416

[51] Int. Cl.[3] ..... H05B 1/02; F24H 1/22

[52] U.S. Cl. ..... 219/314; 122/13 A; 165/132; 219/304; 219/321; 219/326; 219/330; 237/8 A

[58] Field of Search ..... 219/314, 325, 326, 316, 219/320, 321, 302–304, 310–312, 330; 165/132; 122/13 R, 13 A; 237/8 R, 8 A

[56] References Cited

U.S. PATENT DOCUMENTS

| | | | |
|---|---|---|---|
| 1,239,572 | 9/1917 | De Khotinsky | 219/314 |
| 1,954,929 | 4/1934 | Green | 219/314 |
| 2,036,815 | 4/1936 | Leader | 219/326 |

FOREIGN PATENT DOCUMENTS

| | | | |
|---|---|---|---|
| 711968 | 7/1931 | France | 219/316 |
| 1341893 | 9/1963 | France | 219/314 |
| 412218 | 11/1945 | Italy | 219/314 |
| 570316 | 7/1945 | United Kingdom | 219/314 |

*Primary Examiner*—A. Bartis

*Attorney, Agent, or Firm*—Ostrolenk, Faber, Gerb & Soffen

[57] ABSTRACT

A domestic electric water heater includes inner and outer water heating compartments in thermal communication with each other and arranged for free thermal circulation of water therebetween. First and second electric heating elements, individually controlled at different temperatures by separate thermostats responsive to the temperature of the water in the outer compartment, are provided in the inner compartment for directly heating the water therein. First and second groups of water preheating pipe windings, connected in series, are located at the lower and upper portions, respectively, of the outer compartment in heat exchange with the water therein.

7 Claims, 1 Drawing Figure

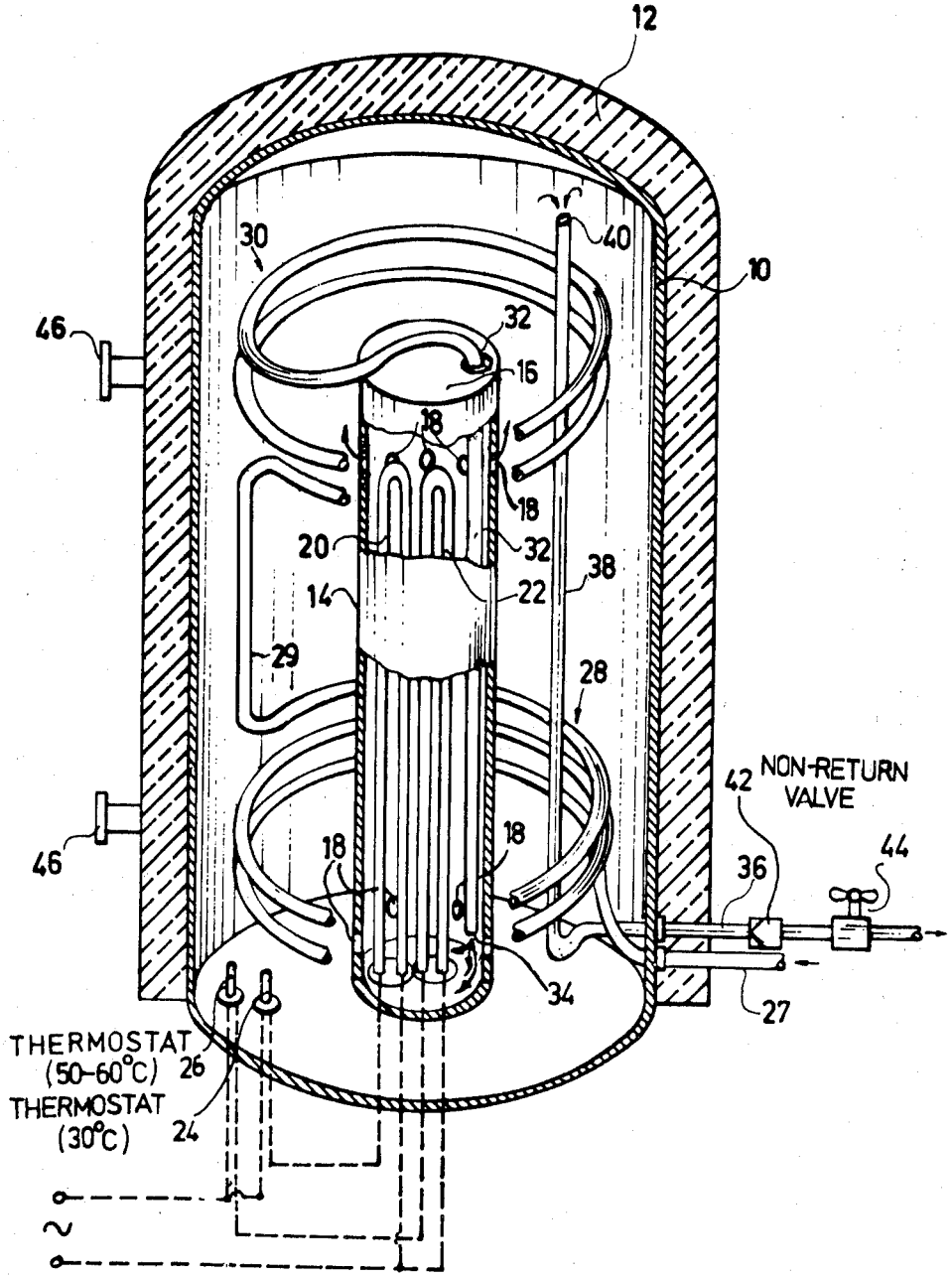
12
30
40
10
46
32
16
18
18
20
32
38
14
22
29
28
42
NON-RETURN VALVE
46
18
18
36
44
34
27
THERMOSTAT (50-60°C)
26
THERMOSTAT (30°C)
24
~

DUAL COMPARTMENT ELECTRIC WATER HEATER

BACKGROUND OF THE INVENTION

The present invention relates to electrically heated water tanks or reservoirs, particularly for domestic use.

Most widely used are the so-called storage heaters having a volume of between 50 and 120 liters. The heaters are provided with a thermostatically regulated electric heating element. The water within the heater is adapted to circulate within the tank by natural thermosyphonic process until substantially the whole volume of the water reaches the required temperature as regulated by the thermostat. The consumption of hot water from a top portion of the heater causes the refilling thereof by cold water entering at the bottom of the tank, which cold water mixes with the warm water contained within the tank. This of course causes a waste of electrical energy, especially where there is not consumed at one time substantially the whole quantity of water contained within the tank.

There exists a second category of electrical water heaters, namely the so-called instant- or flow-heaters, which comprise a small vessel installed at the immediate vicinity of the hot water tap and which are adapted to be actuated by the consumption of water through the tap. Closing the tap automatically deactivates the heating element. These devices require a relatively high power heating element (of about 5 KW) in order to instantly raise the temperature of the water flowing therethrough. Besides the high rated electrical element (which frequently requires a special electrical installation), there is another disadvantage, namely, that there is no possibility to mix the instantly heated water with the cold mains water supply in order to regulate the temperature of the consumed water.

Still another deficiency of the flow heaters resides in that the heating element is usually built-in within the device and therefore not easily replaced in case of its burning up or other failure.

It is the general object of the present invention to overcome the disadvantages of the above-mentioned conventional storage as well as flow domestic water heaters.

It is a further object of the invention to provide a relatively small and therefore more aesthetic and space-saving water heater, which will function both as a storage water heater and as a flow water heater using the existing installation of the conventional large and cumbersome domestic storage heater, and which is readily replaceable for such storage heaters.

SUMMARY OF THE INVENTION

According to the invention there is provided an electric water heater, particularly for domestic use, having a cold water inlet and a heated water outlet, comprising: first and second water heating compartments in thermal communication with each other such as to permit a thermal circulation of water between them; and at least first and second electric heating elements provided within the first compartment, each individually controlled by a separate thermostatic device responsive to the temperature in the second compartment. The heater further includes first and second heat exchanging circulation conduits in fluid-flow communication with each other, provided at a lower and an upper portion of the second compartment, respectively, said cold water inlet being connected to said first circulation conduit; an intermediate water outlet in communication with said second conduit provided within said first compartment for supplying water flowing through said second circulation conduit to said first compartment; and an intermediate water inlet located at an upper portion of said second compartment and connected to said heated water outlet.

According to a preferred embodiment of the invention the said first and second compartments are cylindrical, coaxially located one within the other, and said cold water inlet and heated water outlet are located at a lower portion of the second compartment, the intermediate water outlet is located at a lower portion of the first compartment, and the intermediate water inlet is located at an upper portion of the second compartment.

The said separate thermostatic devices are preset to operate at different temperatures, advantageously 50° C. and 30° C., respectively.

BRIEF DESCRIPTION OF THE DRAWING

The invention will now be described, for the better understanding thereof and merely by way of example, with reference to the accompanying drawing wherein the sole figure is a fragmental schematic three-dimensional view of a heater designed according to a preferred embodiment of the invention.

DESCRIPTION OF A PREFERRED EMBODIMENT

As shown in the drawing there is provided an outer tank 10 covered by a heat insulating layer 12. The tank 10 constitutes the above mentioned second compartment, whereas an inner, centrally located tubular vessel 14 constitutes said first compartment. The first compartment 14 is essentially a length of pipe, made of stainless steel, (for better heat resistence and minimum sediment accumulation) closed at the top 16 thereof and provided with a plurality of openings 18 formed at an upper and a lower portions thereof for the free communication and thermal circulation of water between the interiors of compartment 14 and compartment 10. Within the tube 14 there are installed a pair of conventionally shaped immersion heating elements 20 and 22, electrically connected to and regulated by a pair of thermostats 24 and 26, respectively. The mounting of the tube 14 and/or the elements 20 and 22 is such that it may be readily dismembered from the tank 10 for repair and maintenance purposes.

Unlike the conventional storage heaters which are designed to contain about 100 liters, it is a characteristic feature of the heater according to the present invention that a typical volume of about 10 to 20 liters only will suffice, resulting in a much more pleasant looking and space-saving appliance.

The water heater is provided with a cold water inlet 27 located, as usual, near the bottom of the tank 10. The inlet 27 is connected to one or more pipe windings 28 forming a first circulation conduit in the lower portion of compartment 10 for heat exchanging between water contained in compartment 10 and the incoming water. The pipe windings 28 are preferably made of copper or the like high heat conductive material. Instead of the circular helical windings, any other serpentined configuration may be used.

The first heat exchanging conduit 28 communicates through a pipe section 29 with a second pipe winding 30 constituting a second heat exchanging conduit located at the upper portion of the compartment 10. The heat exchanging conduit 30 is connected to a pipe 32 entering the top cover 16 of the first compartment 14 and extending downwards to form at its open end an intermediate water outlet designated 34 within compartment 14.

The tank 10 is further provided with a hot-water outlet 36 communicating with a vertical pipe section 38 extending vertically through compartment 10 and open at its upper end to provide an intermediate water inlet 40.

A non-return valve 42 and a main control valve 44 would be included in the hot water outlet line 27, as known in the art.

The heater would normally be installed at a bathroom wall by mounting brackets 46.

Let us first assume that the water heater, comprised of both the first and the second compartments 14 and 10 is filled with cold water and the thermostats 24 and 26 are energising both electrical heating elements 20 and 22. Water within the compartment 14 will be heated relatively quickly, by the total capacity of both elements, to a temperature suitable for normal household (kitchen) uses. Such heated water would flow out of the compartment 14 into compartment 10 through the upper openings 18, thereby starting to heat the water in compartment 10 by admixing the heated water from compartment 14 with the cold water in the upper portion of compartment 10, while the colder water in the lower portion of compartment 10 enters compartment 14 through the lower opening 18. The temperature of the whole body of water will thus gradually rise until the first thermostat 24, which is preset to a lower temperature of, say, 30° C., will deactivate the element 20. When this occurs, additional heating will only be supplied by the second element 22 regulated by the thermostat 26, until water at the vicinity of the thermostats will reach the highest required temperature, normally 50° to 60° C., causing the thermostat 26 to cutoff the element 22. An initial quantity of about 10–20 liters of hot water, constituting the volume of both compartments 14 and 10, is now ready for consumption via pipe 38 and outlet 44.

Suppose now that a limited quantity of hot water is consumed through outlet 36 and pipe section 38, resulting immediately in the inletting of cold water through the inlet 26. Such cold water will be subjected to a first heating stage while circulating within the heat-exchanging conduit 28, and then to a second heating stage while circulating through the second heat-exchange conduit 30. The decrease of the water temperature around the thermostat 26 will almost instantly cause the energisation of the associated electrical heating element 22. The preheated—though still relatively cold—water flowing down the pipe section 32 and then out through opening 34 into the compartment 14 will be further and more intensively heated by the element 22. Such heated water will rise and flow out through the upper openings 18 to mix with the remaining still hot water contained in the upper portion of the second compartment 10 and be drawn out through the intermediate hot water inlet 40 to the hot water tap.

However, if hot water is continuously consumed, the temperature of the water within the compartment 10 will further decrease, causing the second thermostat 24 to energise the second electrical heating element 20. This will double the heating rate of the water contained in the first compartment 14, as well as in the pipe branch 32, thus bringing about a more rapid heating of the water within both compartments, to cope with the continuous hot water consumption. At this stage of operation the water heater according to the present invention acts similarly to an instant flow heater, but in a more economic and power saving manner, due to the multistage preheating phases.

Should now the hot water consumption be interrupted, the water within both compartments will continue to be heated first by both elements 20; 22 and, after a short while, element 20 will be cut-off by thermostat 24 and, some time later, when the whole volume of water reaches the high operating temperature, the second thermostat 26 will cut-off also the element 22.

It should be noted that the provision of the first preheating stage by the conduit windings 28 at the bottom of the tank is mainly for protection against over-heating. The thermostats 24 and 26 are therefore installed next to the conduit windings 28.

Experiments with the new water heater as above described using two electric elements rating 2 KW each, have shown that a substantial quantity (10–20 liters) of hot water can be immediately supplied by a relatively small-sized heater, thereby enabling a considerable space saving at the bathroom or elsewhere. It also enables a reduction of energy losses to be achieved when the hot water consumption is non-continuous by minimizing the waste resulted by the mixing of quantities of cold water with the hot water within a single large volume vessel as in the conventional storage heaters.

Many modifications and variations of the construction as so far described may be achieved, and those skilled in the art would readily understand that such modifications and variations would fall within the scope of the present invention as defined in the appended claims.

What is claimed is:

1. An electric water heater, particularly for domestic use, having a cold water inlet and a heated water outlet, comprising: first and second water heating compartments in thermal communication with each other and connected such as to permit a thermal circulation of water between them; at least first and second electric heating elements provided within the first compartment, each individually controlled by a separate thermostatic device responsive to the temperature in the second compartment; first and second heat exchanging circulation conduits in fluid flow communication with each other, provided at a lower and an upper portion of the second compartment, respectively, said cold water inlet being connected to said first circulation conduit; an intermediate water outlet in communication with said second conduit provided within said first compartment for supplying water flowing through said second circulation conduit to said first compartment; and an intermediate water inlet located at an upper portion of said second compartment and connected to said heated water outlet.

2. The water heater as claimed in claim 1, wherein said first compartment is constituted by a vessel located within said second compartment.

3. The water heater as claimed in claim 2 wherein said compartments are cylindrical, coaxially located one within the other.

4. The water heater as claimed in claim 3 wherein said cold water inlet and heated water outlet are located at a lower portion of the second compartment and the intermediate water outlet is located at a lower portion of the first compartment.

5. The water heater as claimed in claim 1 wherein said first and said second heat exchanging circulation conduits are composed of windings of high heat conductivity metal pipes.

6. The water heater as claimed in claim 1 wherein said thermostatic devices are preset to operate at different temperatures.

7. The water heater as claimed in claim 6 wherein one of the thermostatic devices is preset to about 50° C. and the other to about 30° C.

* * * * *